US010720090B2

(12) United States Patent
Lee et al.

(10) Patent No.: US 10,720,090 B2
(45) Date of Patent: Jul. 21, 2020

(54) DISPLAY APPARATUS

(71) Applicant: SAMSUNG DISPLAY CO., LTD., Yongin-si, Gyeonggi-do (KR)

(72) Inventors: Chang-Soo Lee, Suwon-si (KR); Byoungsun Na, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 16/231,657

(22) Filed: Dec. 24, 2018

(65) Prior Publication Data

US 2019/0197937 A1 Jun. 27, 2019

(30) Foreign Application Priority Data

Dec. 27, 2017 (KR) ..... 10-2017-0181469

(51) Int. Cl.
*G09G 3/20* (2006.01)
*G09G 3/36* (2006.01)

(52) U.S. Cl.
CPC ..... *G09G 3/20* (2013.01); *G09G 3/3677* (2013.01); *G09G 2300/0426* (2013.01); *G09G 2310/0243* (2013.01); *G09G 2310/08* (2013.01); *G09G 2320/02* (2013.01)

(58) Field of Classification Search
CPC ... G09G 2300/0426; G09G 2310/0243; G09G 2310/08; G09G 2320/02; G09G 3/20; G09G 3/3677
See application file for complete search history.

(56) References Cited

U.S. PATENT DOCUMENTS

2003/0222311 A1* 12/2003 Kim ..... G02F 1/13454 257/347
2005/0190175 A1* 9/2005 Kim ..... G02F 1/13452 345/204
2007/0229433 A1* 10/2007 Jang ..... G09G 3/3677 345/96
2008/0129717 A1* 6/2008 Lee ..... G09G 3/3677 345/204
2010/0033472 A1* 2/2010 Choi ..... G09G 3/3688 345/213

(Continued)

FOREIGN PATENT DOCUMENTS

KR 10-2009-0113738 11/2009

*Primary Examiner* — Hong Zhou
(74) *Attorney, Agent, or Firm* — F. Chau & Associates, LLC

(57) ABSTRACT

A display apparatus includes a display panel including a display area and a non-display area, in which an image is displayed in the display area and a peripheral area is disposed adjacent to the display area in the non-display area. The display panel includes a plurality of gate lines extending in a first direction, a plurality of data lines extending a second direction which crosses the first direction, and a plurality of unit pixels which are electrically connected to each of the gate lines and the data lines. A gate driver generates a clock signal, and a gate signal generator receives the clock signal and outputs a generated gate signal to the gate line. A clock line transmits the clock signal to the gate signal generator, and a flexible film disposed adjacent to the gate signal generator in the first direction is connected to the display panel in the peripheral area. At least a portion of the clock line is formed on the flexible film.

19 Claims, 10 Drawing Sheets

(56) References Cited

U.S. PATENT DOCUMENTS

| | | | | |
|---|---|---|---|---|
| 2011/0279358 | A1* | 11/2011 | Lee | G11C 19/28 345/87 |
| 2012/0105398 | A1* | 5/2012 | Park | H03K 19/018521 345/206 |
| 2016/0335972 | A1* | 11/2016 | Lee | G09G 3/3677 |
| 2017/0076663 | A1* | 3/2017 | Nishimura | G09G 3/3266 |

* cited by examiner

DISPLAY APPARATUS

CROSS-REFERENCE TO RELATED APPLICATIONS

The present application claims the benefit of priority from Korean Patent Application No. 10-2017-0181469, filed on Dec. 27, 2017, the disclosure of which is incorporated by reference herein in its entirety.

1. Technical Field

Example embodiments of the inventive concept relate to a display apparatus. More particularly, example embodiments of the inventive concept relate to a display apparatus, capable of reducing driving load.

2. Discussion of the Related Art

In response to consumer demand, manufacturers continue to develop a display apparatus having a lighter weight and smaller size for portability, and an enhanced display quality. Older cathode ray tube (CRT) display apparatuses have been replaced with various technologies because their size and weight were not easily reduced, even though CRT display apparatuses provided a very good performance at a competitive price. Therefore, various types of display apparatuses, such as a plasma display apparatus, a liquid crystal display apparatus and an organic light emitting display apparatus, have become very popular due to having a smaller size, lighter weight and lower-power-consumption than CRT's.

The display apparatus generally includes a display panel and a panel driving part. The display panel includes a plurality of gate lines, a plurality of data lines and a plurality of pixels electrically connected thereto. The panel driving part generates a driving signal for driving the pixels and provides the driving signal to the gate lines and the data lines to energy the pixels and display an image.

When a display apparatus is manufactured to have an increased display area, a load of the driving signals increases and a delay in displaying an image may occur. Accordingly, the display quality of the display apparatus may be deteriorated when such display apparatuses are manufactured to have an increased display area. In addition, in a non-display area of the display apparatus, a bezel becomes thicker because the signal lines for transmitting the driving signals are formed in a peripheral area which is the non-display area of the display panel.

SUMMARY

One or more example embodiments of the inventive concept provides a display apparatus that may reduce the driving load and reduce the bezel width.

According to an example embodiment of the inventive concept, a display apparatus includes a display panel comprising a display area in which an image is displayed and a peripheral area includes a non-display area being disposed adjacent to the display area, the display panel comprising a plurality of gate lines extending in a first direction, a plurality of data lines extending a second direction which crosses the first direction, and a plurality of unit pixels electrically connected to each of the gate lines and the data lines; a gate driver configured to generate a clock signal; a gate signal generator disposed in the peripheral area, in which the gate signal generator receives the clock signal from the gate driver, generates a gate signal, and outputs the gate signal to at least one of the gate lines. A clock line transmits the clock signal generated from the gate driver to the gate signal generator; and a flexible film is disposed adjacent to the gate signal generator in the first direction and extending from the display panel, and the flexible film is connected to the display panel in the peripheral area, and at least a portion of the clock line is formed on the flexible film.

In an example embodiment of the inventive concept, a thin-film transistor of the gate signal generator and a thin-film transistor of the unit pixel may be formed from a same layer.

In an example embodiment of the inventive concept, the display apparatus may further include a driving substrate on which the gate driver is mounted, and a flexible circuit board which connects the driving substrate to the display panel.

In an example embodiment of the inventive concept, the clock lines may extend from the gate driver of the driving substrate to the gate signal generator through the driving substrate, the flexible circuit board, the peripheral area of the display panel, the flexible film and the peripheral area of the display panel to be connected to the gate signal generator.

In an example embodiment of the inventive concept, the display apparatus may further include a data driver to output a data voltage to the data lines. The data lines may extend from the data driver into the display area through the flexible circuit board, and the peripheral area of the display panel.

In an example embodiment of the inventive concept, the flexible film may be directly connected to the driving substrate. The clock line may extend from the gate driver of the driving substrate to the gate signal generator through the driving substrate, the flexible film, and the peripheral area of the display panel to be connected to the gate signal generator.

In an example embodiment of the inventive concept, the gate signal generator may include a left gate signal generator formed on a left side of the display panel and a right side gate signal generator formed on a right side of the display panel. One of the gate lines may be connected to the left gate signal generator and the right gate signal generator.

In an example embodiment of the inventive concept, the flexible film may include a first flexible film disposed adjacent to the left gate signal generator, and a second flexible film disposed adjacent to the right gate signal generator. The clock line may include a left clock signal line electrically connected to the left gate signal generator and a right clock signal line electrically connected to the right gate signal generator.

In an example embodiment of the inventive concept, the flexible film may include a first flexible film and a second flexible film spaced apart from the first flexible film in the second direction. The clock line may include a first clock line, an a-th clock line, and a a+1-th clock line (here, 'a' is a natural number greater than 1). The gate signal generator may include a first gate signal generator, an a-th gate signal generator, and an a+1-th gate signal generator. The first clock line and the a-th clock line may extend from the gate driver to the first and a-th gate signal generators through the peripheral area of the display panel, the first flexible film, the peripheral area of the display panel. The a+1-th first clock line may extend from the gate driver to a+1-th gate signal generator through the peripheral area of the display panel, the first flexible film, the peripheral area of the display panel, the second flexible film, and the peripheral area of the display panel.

In an example embodiment of the inventive concept, the first flexible film and the second flexible film may be substantially the same.

In an example embodiment of the inventive concept, the first flexible film and the second flexible film each may include first to n-th lines, and at least one of the first to n-th lines of the second flexible film may be floated as a dummy pattern.

In an example embodiment of the inventive concept, the display apparatus may further include a timing controller which receives input image data and input control signal, and generates a first control signal, a second control signal, a third control signal and a data signal, a gamma reference voltage generator which receives the third control signal and generates a gamma reference voltage, and a data driver which the second control signal, the data signal and receives the gamma reference voltage, and outputs a data voltage to the data lines. The gate driver may receive the first control signal.

In an example embodiment of the inventive concept, the display apparatus may further include a driving substrate on which the timing controller, the gamma reference voltage generator and the gate driver are mounted, and a flexible circuit board which connects the driving substrate to the display panel. The clock line may extend from the gate driver of the driving substrate to the gate signal generator through the driving substrate, the flexible circuit board, the peripheral area of the display panel, the flexible film and the peripheral area of the display panel to be connected to the gate signal generator.

In an example embodiment of the inventive concept, the flexible film may be bent in a C-shape, so that an edge of the display panel on a cross-sectional view may be disposed between both ends of the flexible film. The at least one clock line may include a plurality of clock lines arranged on the flexible film bent in the C-shape.

In an example embodiment of the inventive concept, the flexible film may be bonded to a side of the display panel.

In an example embodiment of the inventive concept, the clock line on the flexible film may include a first clock line and a second clock line. The first clock line may include a first resistance portion, the second clock line comprises a second resistance portion having a resistance value different from that of the first resistor portion.

According to an example embodiment of the inventive concept, a display apparatus includes a gate driver to generate a clock signal, a first gate signal generator which is directly integrated on a display panel, receives the clock signal and generates a gate signal, a first gate line which is electrically connected to the first gate signal generator, receives the gate signal, and extends in a first direction, a first clock line which electrically connects the gate driver to the first gate signal generator to transmit the clock signal, and a flexible film which is disposed adjacent to the first gate signal generator in the first direction, and is connected to the display panel, a portion of the first clock line being formed on the flexible film.

In an example embodiment of the inventive concept, the flexible film may extend along an edge of the display panel in a second direction perpendicular to the first direction.

In an example embodiment of the inventive concept, the gate signal generator may include a thin-film transistor.

In an example embodiment of the inventive concept, the first clock line may extend from the gate driver through the display panel, the first flexible film, and the display panel, for example, may be arranged in a particular order or configuration, and is connected to the first gate signal generator. However, a person of ordinary skill in the art should understand and appreciate that the embodiments of the inventive concept are not limited to any one particular configuration.

According to example embodiments of the inventive concept, a display apparatus may include a display panel, a gate driver, a gate signal generator, a clock line, and a flexible film. Most of the clock lines are formed on the flexible film, and circuit wirings formed on the flexible film generally have a small resistance value compared with circuit wirings integrated on the display panel, so that a load may be reduced. Thus, even if the display apparatus is enlarged, deterioration of display quality due to delay of the clock signal can be prevented.

In addition, as most of the clock lines are formed on the flexible film, and size of a peripheral area, which is the non-display region, can be reduced compared to a case where the entire clock line is formed on the peripheral area of the display panel 100. Accordingly, a display apparatus with a reduced bezel width can be provided.

In addition, the flexible film may include a plurality of flexible films, and these flexible films can be formed of the same film, and can be applied to a single film design, so that the manufacturing cost can be reduced. For example, there may be several layers of flexible film disposed on top of each other.

In addition, the flexible film may be bent toward back of the display panel, or side-bonded at a side of the display panel, so that bezel width can be further reduced.

In addition, the clock lines of the flexible film may include a resistance portion, so that deviation of clock signal according to a difference in a length of the clock line can be reduced and the display quality can be increased.

In addition, the clock line may include a plurality of clock lines formed on a portion of the flexible film extending from the display panel.

The plurality of clock lines formed on the flexible film may have a resistance value less than a resistance of clock lines integrated on the display panel.

It is to be understood that both the foregoing general description and the following detailed description are exemplary and explanatory and are intended to provide further explanation of the embodiments of the inventive concept.

BRIEF DESCRIPTION OF THE DRAWINGS

The embodiments of the inventive concept will be better-appreciated by a person of ordinary skill in the art by describing in detail example embodiments thereof with reference to the accompanying drawings, in which.

DETAILED DESCRIPTION

Hereinafter, embodiments of the inventive concept will be explained in detail with reference to the accompanying drawings.

Figure 1:
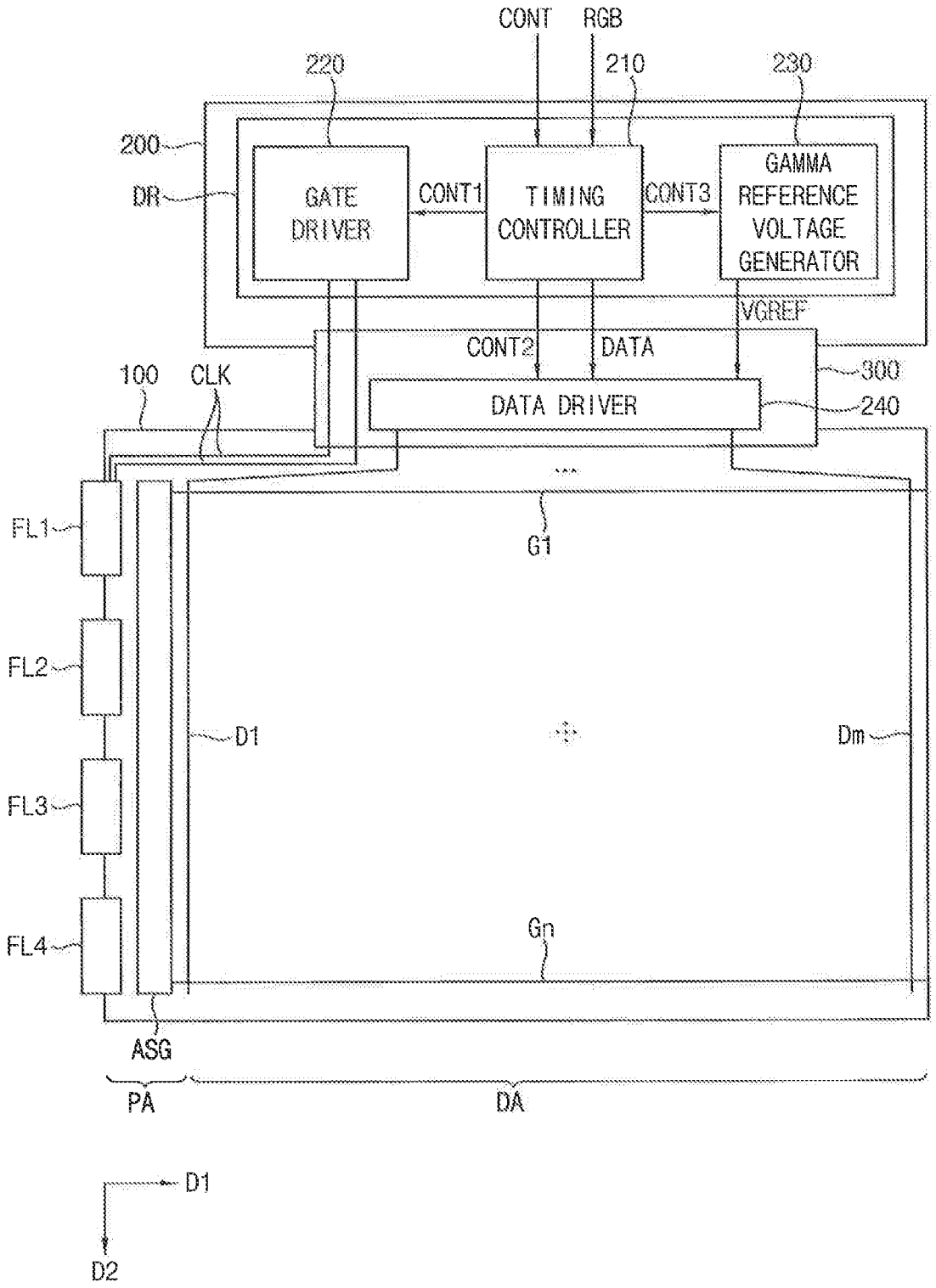
FIG. 1 is a plan view illustrating a display apparatus according to an example embodiment of the inventive concept.

FIG. 1 is a plan view illustrating a display apparatus according to an example embodiment of the inventive concept.

Referring now to FIG. 1, the display apparatus may include a display panel 100, a driving board (e.g., driving substrate 200), a driving circuit part DR including a timing controller 210, a gate driver 220 and a gamma reference voltage generator 230, a gate signal generator ASG, a data driver 240, a voltage generator (not shown), a first flexible film FL1, a second flexible film FL2, a third flexible film FL3, a fourth flexible film FL4 and a flexible circuit board 300.

The display panel may include a display area DA in which an image is displayed, and a peripheral area PA, which is a non-display area. The peripheral area PA is adjacent to the display area DA.

The display panel 100 may include a plurality of gate lines G1 to Gn, a plurality of data lines D1 to Dm and a plurality of unit pixels which are electrically connected to each of the gate lines G1 to Gn and the data lines D1 and Dm. The gate lines G1 to Gn may extend in a first direction D1, and the data lines D1 to Dm may extend in a second direction D2 which crosses the first direction D1.

Each unit pixel may include a switching element (not shown), a liquid crystal capacitor (not shown) and a storage capacitor (not shown). The liquid crystal capacitor and the storage capacitor may be electrically connected to the switching element. The unit pixels may be disposed in, for example, a matrix form.

The driving board (driving substrate 200) may be connected to the display panel 100 by a flexible connection, such as, for example, the flexible circuit board 300. The driving circuit part DR may be mounted on the driving board (driving substrate 200). The driving circuit part DR may include the timing controller 210, the gate driver 220 and the gamma reference voltage generator 230.

The timing controller 210 may receive input image data RGB and an input control signal CONT from an external apparatus (not shown). The input image data may include red image data R, green image data G and blue image data B. The input control signal CONT, which is provided from the external apparatus, may include a master clock signal and a data enable signal. The input control signal CONT may include a vertical synchronizing signal and a horizontal synchronizing signal.

The timing controller 210 may generate a first control signal CONT1, a second control signal CONT2, a third control signal CONT3 and a data signal DATA based on the input image data RGB and the input control signal CONT.

The timing controller 210 may generate the first control signal CONT1 that is output to the gate driver 220 to control an operation of the gate driver 220 based on the input control signal CONT. The first control signal CONT1 may further include, for example, a vertical start control signal and a gate clock control signal.

The timing controller 210 may generate the second control signal CONT2 to control an operation of the data driver 240 based on the input control signal CONT, and outputs the second control signal CONT2 to the data driver 240. The second control signal CONT2 may include a horizontal start signal and a load signal.

With continued reference to FIG. 1, the timing controller 210 may generate the data signal DATA based on the input image data RGB. The timing controller 210 may output the data signal DATA to the data driver 240.

The timing controller 210 may generate the third control signal CONT3 for controlling an operation of the gamma reference voltage generator 230 based on the input control signal CONT, and output the third control signal CONT3 to the gamma reference voltage generator 230.

The gate driver 220 may generate a gate driving signal in response to the first control signal CONT1 received from the timing controller 210 and a driving voltage received from the voltage generator. The gate driving signal may include, for example, a clock signal.

In addition, the clock signal may be transmitted from the gate driver 220 to the gate signal generator ASG through the clock line CLK. The clock line CLK may be formed from the gate driver 220 on the driving substrate 200 to the first flexible film FL1 through the flexible circuit board 300 and an upper side of the peripheral area PA of the display panel 100. A portion of the clock line CLK may be connected to the gate signal generator ASG through the first flexible film FL1. Another portion of the clock line CLK may be connected to the gate signal generator ASG through the first flexible film FL1, the peripheral area PA of the display panel 100 and the second flexible film FL2. Still another portion of the clock line CLK may be connected to the gate signal generator ASG through the first flexible film FL1, the peripheral area PA of the display panel 100, the second flexible film FL2, the peripheral area PA of the display panel 100 and the third flexible film FL3. Still another portion of the clock line CLK may be connected to the gate signal generator ASG through the first flexible film FL1, the peripheral area PA of the display panel 100, the second flexible film FL2, the peripheral area PA of the display panel 100, the third flexible film FL3, the peripheral area PA of the display panel 100, and the fourth flexible film FL4. A detailed description thereof will be described later with reference to FIGS. 2, 3A and 3B.

The first flexible film FL1, the second flexible film FL2, the third flexible film FL3 and the fourth flexible film FL4 may be connected to the display panel 100 with being disposed adjacent to the gate signal generator ASG at one side of the display panel 100 in the first direction D1. Connection between the display panel 100 and the first to fourth flexible films FL1 to FL4 may be realized by various known methods. The first flexible film FL1, the second flexible film FL2, the third flexible film FL3 and the fourth flexible film FL4 may be arranged in the second direction in succession. However, a person of ordinary skill in the art should understand that the embodiments of the inventive concept are not limited to such an arrangement.

The gate signal generator ASG may generate gate signals for driving the gate lines G1 to Gn in response to a gate driving signal such as the clock signal inputted from the gate driver 220. The gate signal generator ASG may sequentially output the gate signals to the gate lines G1 to Gn.

For example, the gate signal generator ASG may be an amorphous silicon gate signal generator integrated in the peripheral area PA of the display panel 100. Thus, the gate signal generator ASG may include a thin-film transistor, and the thin-film transistor may be formed from a same layer as the thin-film transistor of the unit pixel. For example, when the thin-film transistor of the unit pixel is patterned, the thin-film transistor of the gate signal generator ASG may be formed together.

The gamma reference voltage generator 230 may generate a gamma reference voltage VGREF in response to receiving the third control signal CONT3 from the timing controller 210. The gamma reference voltage generator 230 may provide the gamma reference voltage VGREF to the data driver 240. The gamma reference voltage VGREF may have a value corresponding to a level of the data signal DATA.

In some example embodiments of the inventive concept, the gamma reference voltage generator 230 may be disposed in the timing controller 210, or disposed in the data driver 240.

The data driver 240 may receive the second control signal CONT2 and the data signal DATA from the timing controller 210, and receive the gamma reference voltages VGREF from the gamma reference voltage generator 230. The data driver 240 may convert the data signal DATA into analog data voltages using the gamma reference voltages VGREF. The data driver 240 may sequentially output the data voltages to the data lines D1 to Dm.

The data driver 240 may include a shift register (not shown), a latch (not shown), a signal processing part (not shown) and a buffer part (not shown). The shift register may output a latch pulse to the latch. The latch may temporally store the data signal DATA. The latch may output the data signal DATA to the signal processing part. The signal processing part may generate a analog data voltage based on the digital data signal and the gamma reference voltage VGREF. The signal processing part may output the data voltage to the buffer part. The buffer part may compensate the data voltage to have a uniform level. The buffer part may output the compensated data voltage to the data line D1 to Dm.

The data driver 240 may be connected to the display panel 100 in a form of a tape carrier package (TCP) on the flexible circuit board 300. In addition, the data driver 240 may be connected to the display panel 100 in a form of a chip on film (COF) mounted directly on the flexible circuit board 300. In addition, the data driver 240 may be mounted directly on the display panel 100 or may be integrated on the peripheral area of the display panel 100.

The voltage generator may generate the driving voltage used to generate the gate signal and may output the driving voltage to the gate driver 220. The driving voltage may include a gate on voltage and a gate off voltage.

According to an embodiment of the inventive concept, the clock signal may be provided to the gate signal generator ASG integrated on the display panel 100 along the clock line CLK. The clock line CLK may be formed from the gate driver 220 to the gate signal generator ASG through the driving substrate 200, the flexible circuit board 300, the peripheral area PA of the display panel 100, the first through fourth flexible films FL1 and FL2, FL3, FL4.

As the display device becomes larger, the load may be increased by an increase of the length of the clock line CLK. Then, delay of the clock signal corresponding to the first gate line G1 and the clock signal corresponding to the n-th gate line Gn may occur. According to the present embodiment of the inventive concept, most of the clock lines CLK are formed on the first to fourth flexible films FL1, FL2, FL3 and FL4, and circuit wirings formed on the first to fourth flexible films FL1, FL2, FL3 and FL4 generally have a small resistance value compared with circuit wirings integrated on the display panel 100, so that the load may be reduced. Thus, even if the display apparatus is enlarged, a deterioration of display quality due to the delay of the clock signal can be prevented.

In addition, as most of the clock lines CLK are formed on the first to fourth flexible films FL1, FL2, FL3, and FL4, and the size of the peripheral area PA, which is the non-display region, can be reduced compared to a case where the entire clock line CLK is formed on the peripheral area PA of the display panel 100. Accordingly, a display apparatus with a reduced bezel width can be provided.

Although not shown in the figures, a driving voltage line carrying the driving voltage, such as the gate-on voltage and the gate-off voltage, as well as the clock signal, may be also connected to the gate signal generator ASG through the driving substrate 200, the flexible circuit board 300, the display panel 100 and the first to fourth flexible films FL1, FL2, FL3, FL4 similar to the clock signal line CLK. Thus, the driving voltage line that transmits the driving voltage may be formed on the first to fourth flexible films FL1, FL2, FL3 and FL4 in the same manner as the clock line CLK to which the clock signal is transmitted.

Figure 2:
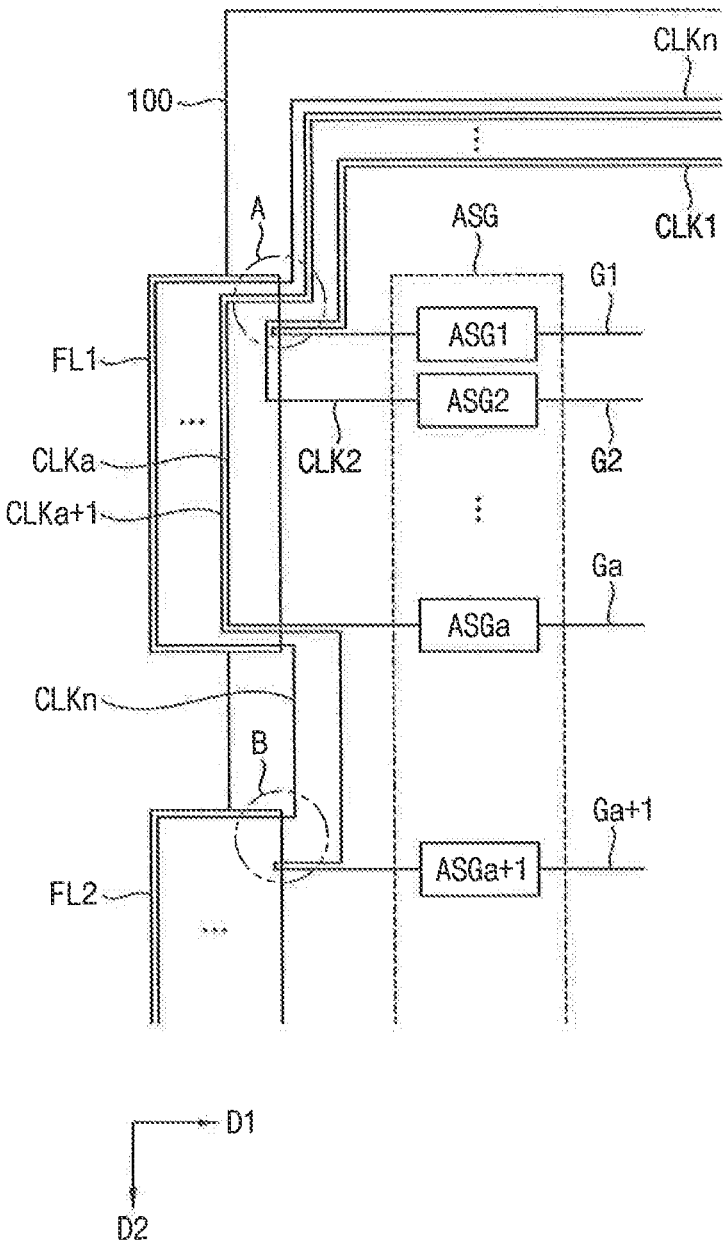
FIG. 2 is a partially enlarged view illustrating an upper left portion of the display apparatus of FIG. 1.
Figure 3A:
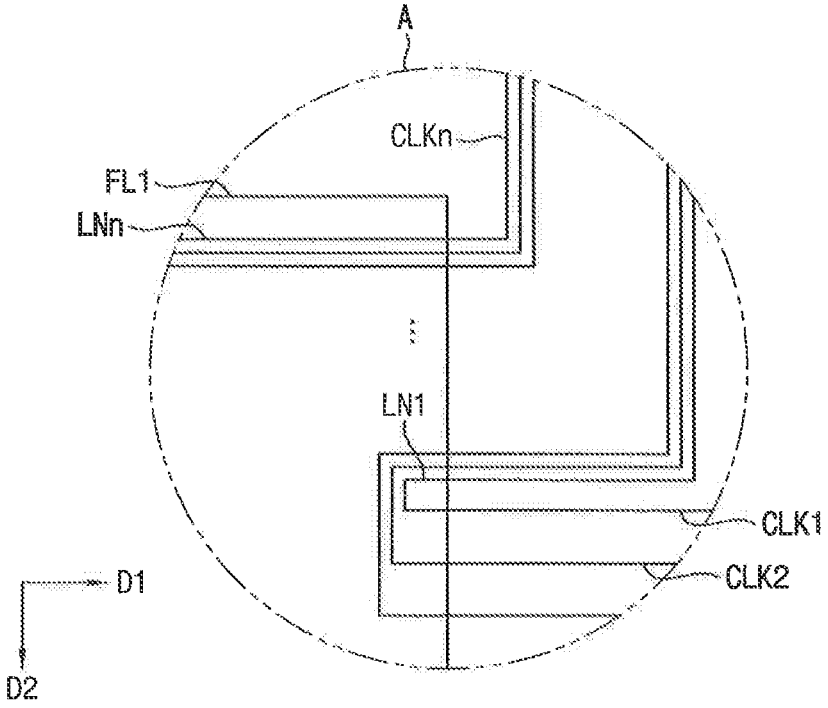
FIG. 3A is partially enlarged view illustrating an 'A' portion of the display apparatus of FIG. 2.
Figure 3B:
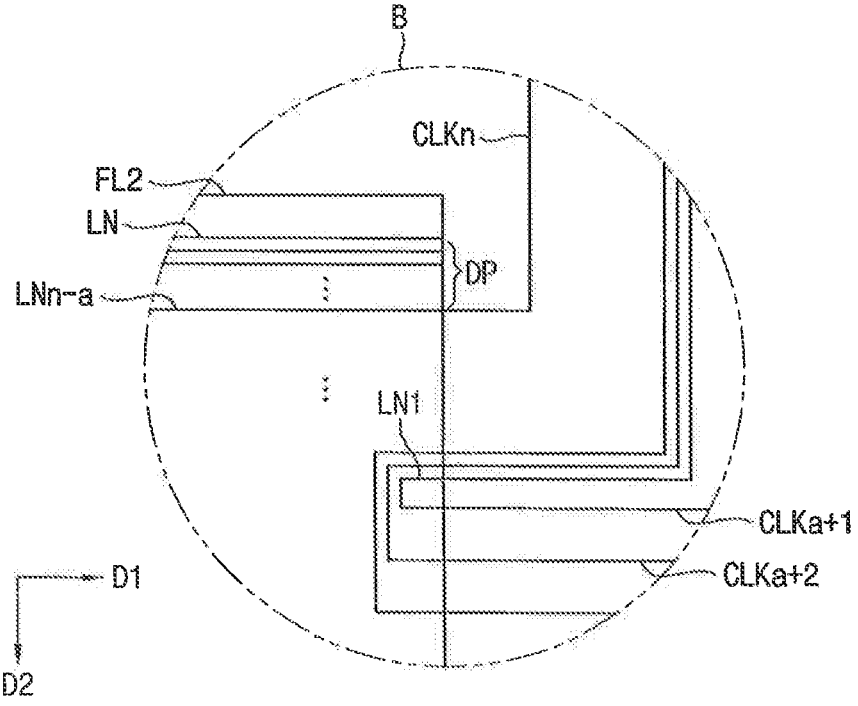
FIG. 3B is partially enlarged view illustrating a 'B' portion of the display apparatus of FIG. 2.

FIG. 2 is a partially enlarged view illustrating an upper left portion of the display apparatus of FIG. 1. FIG. 3A is partially enlarged view illustrating an 'A' portion of the display apparatus of FIG. 2. FIG. 3B is partially enlarged view illustrating a 'B' portion of the display apparatus of FIG. 2.

Referring to FIGS. 1, 2, 3A and 3B, The display apparatus may include a display panel 100, a driving circuit part DR disposed on the driving board (driving substrate 200), the driving circuit part DR including a timing controller 210, a gate driver 220 and a gamma reference voltage generator 230. A gate signal generator ASG a data driver 240, a voltage generator (not shown), a first flexible film FL1, a second flexible film FL2, a third flexible film FL3, a fourth flexible film FL4 and a flexible circuit board 300.

The display panel 100 may include a display area DA in which an image is displayed, and a peripheral area PA which is a non-display area adjacent to the display area DA.

The display panel 100 may include a plurality of gate lines G1 to Gn and a plurality of data lines D1 to Dm, and a plurality of unit pixels which are electrically connected to each of the gate lines G1 to Gn and the data lines D1 and Dm.

The gate lines may include a first gate line G1, a second gate line G2, an a-th gate line Ga, an a+1-th gate line Ga+1, and an n-th gate line Gn. (here, 'a' and 'n' are natural numbers satisfying $1<a$, $a+1<n$) As shown, for example, in FIG. 2, the gate signal generator ASG may include a first gate signal generator ASG1, a second gate signal generator ASG2, an a-th gate signal generator ASGa and an a+1-th gate signal generator ASGa+1. Although not shown in the figures, the gate signal generator ASG may further include an n-th gate signal generator corresponding to the n-th gate line Gn.

The clock line may include a first clock line CLK1, a second clock line CLK2, an a-th first clock line CLKa, an a+1-th clock line CLKa+1, and an n-th clock line CLKn.

The first clock line CLK1 may extend along the first direction D1 at an upper side of the peripheral area PA of the display panel 100. The first clock line CLK1 may be formed on the first flexible film FL1 and extend in the second direction D2. The first clock line CLK1 may extend back along the first direction D1 on the display panel 100 and be connected to the first gate signal generator ASG1. The first gate signal generator ASG1 may be connected to the first gate line G1. Thus, the first clock line CLK1 may extend from the gate driver 220 to the first gate signal generator ASG1 through the driving substrate 200, the flexible circuit board 300, the upper side of the peripheral area PA of the display panel 100, the first flexible film FL1 and a left side of the peripheral area PA of the display panel 100.

With continued reference to FIG. 2, the second clock line CLK2 may extend along the first direction D1 at the upper side of the peripheral area PA of the display panel 100. The second clock line CLK2 may be formed on the first flexible film FL1 and extend in the second direction D2. The second clock line CLK2 may extend back along the first direction D1 on the display panel 100 and be connected to the second gate signal generator ASG2. The second gate signal generator ASG2 may be connected to the second gate line G2. Thus, the second clock line CLK2 may extend along a path from the gate driver 220 to the second gate signal generator ASG2 through the driving substrate 200, the flexible circuit board 300, the upper side of the peripheral area PA of the display panel 100, the first flexible film FL1 and the left side of the peripheral area PA of the display panel 100.

The a-th clock line CLKa may extend along the first direction D1 as shown at the upper side of the peripheral area PA of the display panel 100. The a-th clock line CLKa may be formed on the first flexible film FL1 and extend in the second direction D2. The a-th clock line CLKa may extend back along the first direction D1 on the display panel 100 and be connected to the a-th gate signal generator ASGa. The a-th gate signal generator ASGa may be connected to the a-th gate line Ga. Thus, the a-th clock line CLKa may extend from the gate driver 220 to the a-th gate signal generator ASGa through the driving substrate 200, the flexible circuit board 300, the upper side of the peripheral area PA of the display panel 100, the first flexible film FL1 and the left side of the peripheral area PA of the display panel 100.

FIG. 2 shows that the a+1-th clock line CLKa+1 may extend along the first direction D1 at the upper side of the peripheral area PA of the display panel 100. The a+1-th clock line CLKa+1 may be formed on the first flexible film FL1 and extend in the second direction D2. The a+1-th clock line CLKa+1 may extend in the second direction D2 on the display panel 100 to the second flexible film FL2. The a+1-th clock line CLKa+1 may extend in the second direction D2 on the second flexible film FL2. The a+1-th clock line CLKa+1 may extend back along the first direction D1 on the display panel 100 and be connected to the a+1-th gate signal generator ASGa+1. The a+1-th gate signal generator ASGa+1 may be connected to the a+1-th gate line Ga+1. Accordingly, the a+1-th clock line CLKa+1 may extend from the gate driver 220 to the a+1-th gate signal generator ASGa+1 through the driving substrate 200, the flexible circuit board 300, the upper side of the peripheral area PA of the display panel 100, the first flexible film FL1, the left side of the peripheral area PA of the display panel 100 and the second flexible film FL2 and the left side of the peripheral area PA of the display panel 100.

Although not shown in detail for the third flexible film FL3 and the fourth flexible film FL4, there may be clock lines formed on the third and fourth films that are similar to the clock lines formed on the first flexible film FL1 and the second flexible film FL2.

Referring again to FIGS. 3A and 3B, the first to fourth flexible films FL1 to FL4 may all be constructed of the same film. If a wiring design of the clock line and the first to fourth flexible films FL1 to FL4 are constructed as shown in the figures, the first to fourth flexible films FL1 to FL4 may be formed using the same film. However, embodiments of the inventive concept are not limited to this construction.

The first to fourth flexible films FL1 to FL4 may include first to n-th lines LN1 to LNn, respectively.

More specifically, with reference to FIGS. 3A and 3B, the first flexible film FL1, the first to n-th clock lines CLK1 to CLKn extending from the gate driver 220 may be connected to the first lines LN1 to LNn, respectively, so that the first line LN1 to the a-th line (not shown) of the first flexible film FL1 becomes a portion of the first to a-th clock lines CLK1 to CLKa+1 and are connected to the first to a-th gate signal generators ASG1 to ASGa.

In addition, in the second flexible film FL2, the first to n-a-th clock lines CLKa to CLKn-a extending through the first flexible film FL1 may be connected to the first to n-a lines LN1 to LNn-a. Accordingly, the first to n-a-th lines LN1 to LNn-a of the second flexible film FL2 becomes a part of the a+1-th to n-th clock lines CLKa+1 to CLKn, and are connected to the a+1-th to n gate signal generators ASGa+1 to ASGn. Here, an n-a+1-th to n-th lines LNn-a+1 to LNn may be a dummy pattern, and may be floated without being connected to the clock lines.

In addition, a person of ordinary skill in the art should understand and appreciate that while only the first and second flexible films FL1 and FL2 have been shown in an enlarged view in the figures, the clock lines and the lines on the flexible film may be connected to each other similarly in the case of the third and fourth flexible films FL3 and FL4 as discussed with regard to the first and second flexible films FL1 and FL2. Accordingly, the first to fourth flexible films FL1 to FL4 may be formed of the same film, and can be applied to a single film design, so that the manufacturing costs can be reduced.

Figure 4:
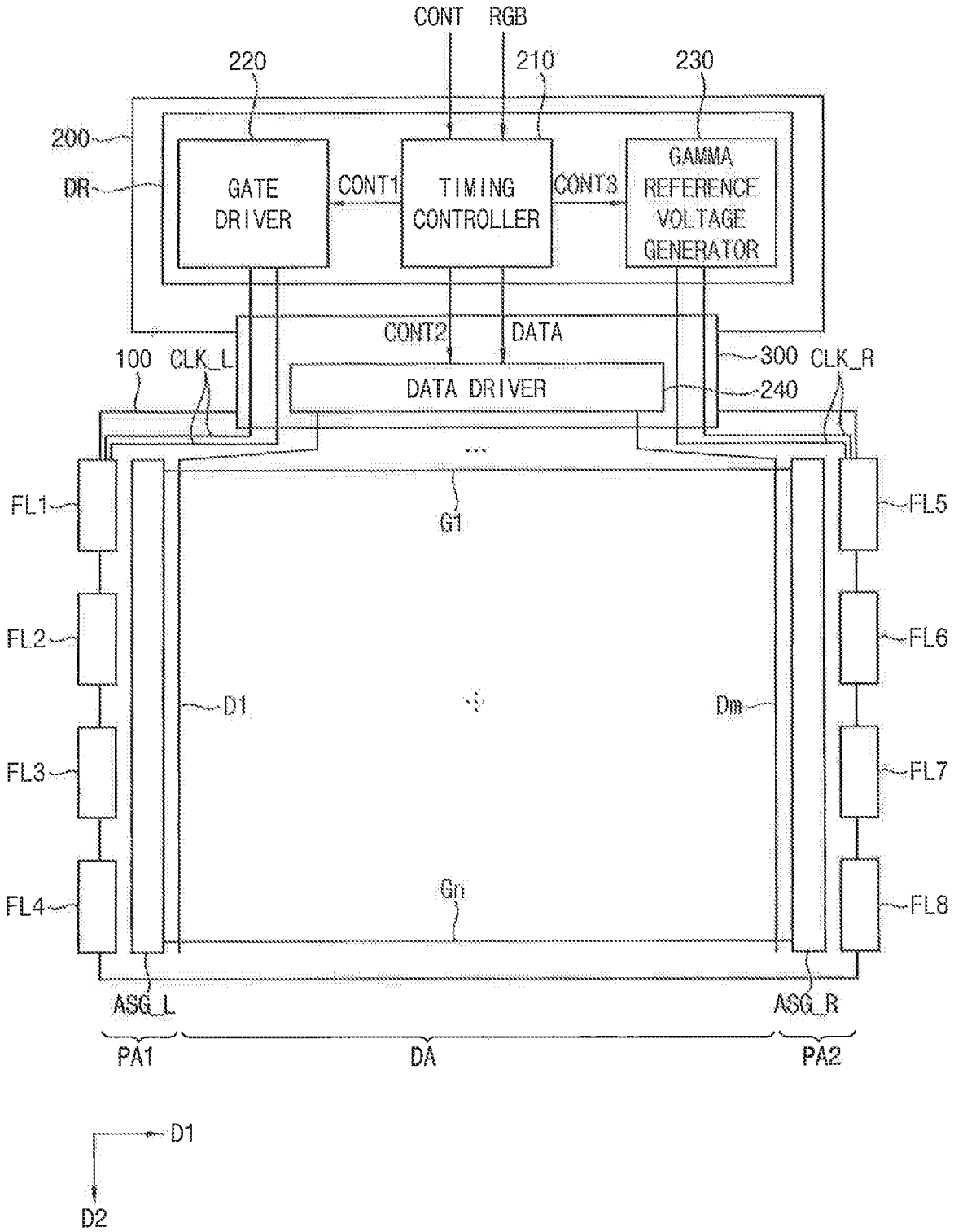
FIG. 4 is a plan view illustrating a display apparatus according to an example embodiment of the inventive concept.
Figure 5:
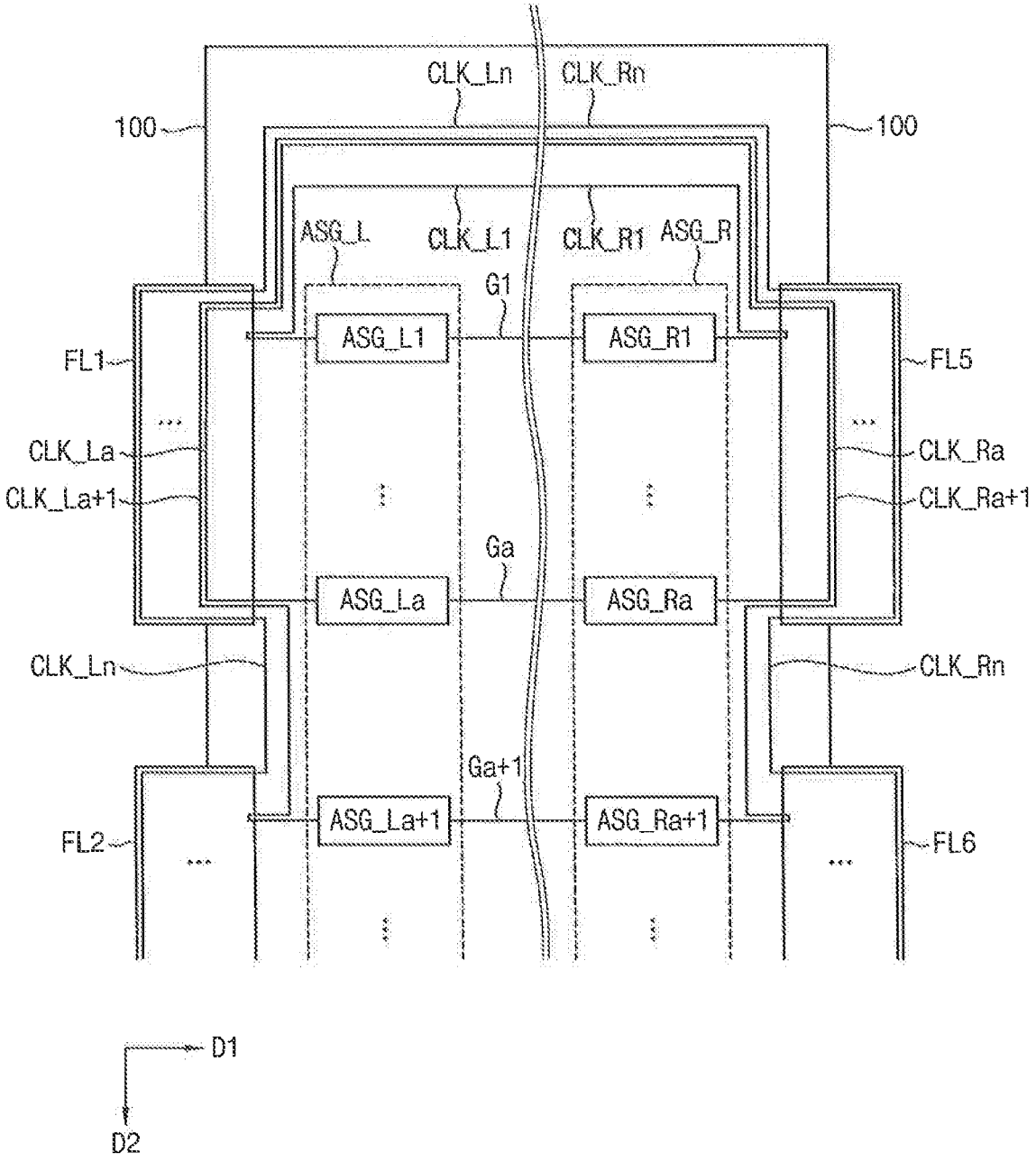
FIG. 5 is a partially enlarged view illustrating an upper left portion and an upper right portion of the display apparatus of FIG. 4.

FIG. 4 is a plan view illustrating a display apparatus according to an example embodiment of the inventive concept. FIG. 5 is a partially enlarged view illustrating an upper left portion and an upper right portion of the display apparatus of FIG. 4.

Referring to FIGS. 4 and 5, the display apparatus may be substantially same as the display apparatus shown in FIGS. 1 to 3, except for a left clock line CLK_L, a right clock line CLK_R, a left gate signal generator ASG_L, a right gate signal generator ASG_R and first to eighth flexible films FL1 to FL8. Therefore, a description of the structure shown in FIGS. 4 and 5 that is repetitive with regard to the display apparatus shown in FIGS. 1 to 3 will be simplified or omitted.

The display apparatus may include a display panel 100, a driving board (driving substrate 200), a driving circuit part DR including a timing controller 210, a gate driver 220 and a gamma reference voltage generator 230, a left gate signal generator ASG_L, a right gate signal generator ASG_R, a data driver 240, a voltage generator (not shown), a first flexible film FL1, a second flexible film FL2, a third flexible film FL3, a fourth flexible film FL4, a fifth flexible film FL5, a sixth flexible film FL6, a seventh flexible film FL7 and an eighth flexible film FL8 and a flexible circuit board 300.

The display panel 100 may include a display area DA for displaying an image and left and right peripheral areas PA1 and PA2, both of which are non-display areas disposed adjacent to the display area DA. As shown in the embodiment of FIG. 4, the display area is bounded on at least two sides by a respective one of a left peripheral area PA1 and right peripheral area PA2.

The display panel 100 may include a plurality of gate lines G1 to Gn and a plurality of data lines D1 to Dm, and a plurality of unit pixels which are electrically connected to each of the gate lines G1 to Gn and the data lines D1 and Dm.

The driving board (driving substrate 200) may be connected to the display panel 100 by the flexible circuit board 300. The driving circuit part DR may be mounted on the driving board (driving substrate 200). The driving circuit part DR may include the timing controller 210, the gate driver 220 and the gamma reference voltage generator 230.

The gate lines may include a first gate line G1, an a-th gate line Ga, an a+1-th gate line Ga+1, and an n-th gate line Gn (here, 'a' and 'n' are natural numbers satisfying 1<a, a+1<n).

With continued reference to FIGS. 4 and 5, the left gate signal generator ASG_L may include a first left gate signal generator ASG_L1, an a-th left gate signal generator ASG_La, and an a+1-th left gate signal generator ASG_La+1. Although not shown in the figures, the left gate signal generator ASG_L may further include an n-th left gate signal generator corresponding to the nth gate line Gn.

The right gate signal generator ASG_R may include a first right gate signal generator ASG_R1, an a-th right gate signal generator ASG_Ra, and an a+1-th right gate signal generator ASG_Ra+1. Although not shown in the figures, the right gate signal generator ASG_R may further include an n-th right gate signal generator corresponding to the nth gate line Gn.

A clock line may include a left clock line CLK_L and a right clock line CLK_R. The left clock line CLK_L may include a first left clock line CLK_L1, an a-th left clock line CLK_La, an a+1-th left clock line CLK_La+1 and an n-th left clock line (not shown). The right clock line CLK_R may include a first right clock line CLK_R1, an a-th right clock line CLK_Ra, an a+1-th right clock line CLK_Ra+1 and an n-th right clock line (not shown).

The left clock line CLK_L may be arranged in the same manner as the clock line of the display apparatus of FIGS. 1 to 3, and the right clock line CLK_R may be formed symmetrically with the left clock line CLK_L. Accordingly, each of the gate lines may receive the gate signal from the left direction through the left clock line CLK_L and the left gate signal generator ALSG_L, and at the same time, the gate signal may be received from the right side through the right clock line CLK_R and the right gate signal generator ASG_R, and such a configuration may prevent a deteriorated display quality due to delay of the gate signal, even if the display apparatus is enlarged.

In addition, most of the left and right clock lines CLK_L and CLK_R are formed on the first to eighth flexible films FL1 to FL8, and the circuit wirings formed on the first to eighth flexible films FL1 to FL8 generally have a small resistance value compared with circuit wirings integrated on the display panel 100, so that the load may be reduced. Accordingly, if the display apparatus has a construction that is enlarged (e.g., relative to smaller display apparatuses), the deterioration of display quality due to delay of the clock signal can be prevented.

In addition, as most of the left clock lines CLK_L and right clock lines CLK_R are formed on the first to eighth flexible films FL1 to FL8, and the size of the peripheral area PA, which is the non-display region, may be reduced compared to a case where the entirety of the left clock lines CLK_L and right clock lines CLK_R are formed on the first peripheral area PA1 and second peripheral area PA2 of the display panel 100. Accordingly, a display apparatus with a reduced bezel width can be provided.

Figure 6:
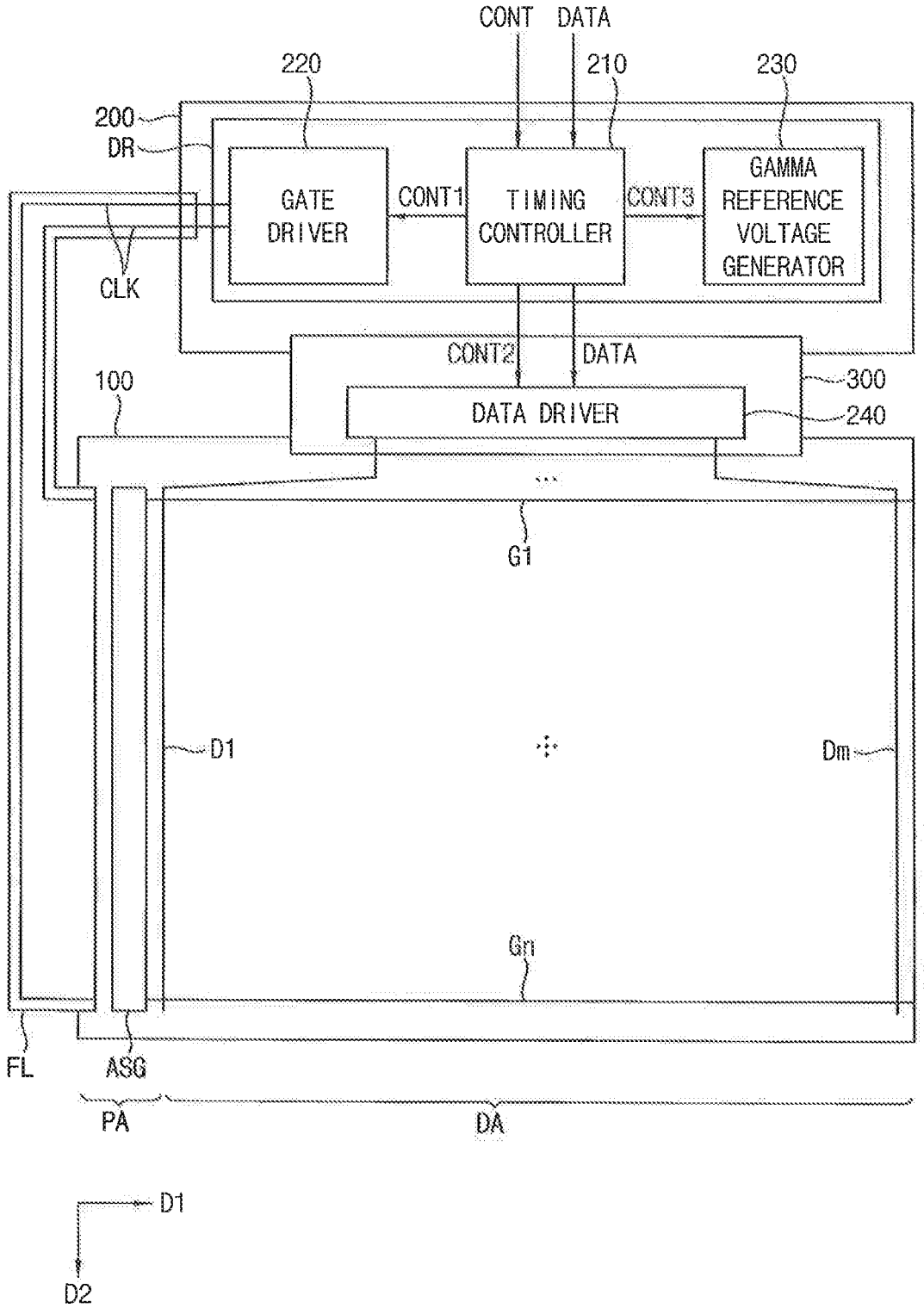
FIG. 6 is a plan view illustrating a display apparatus according to an example embodiment of the inventive concept.
Figure 7:
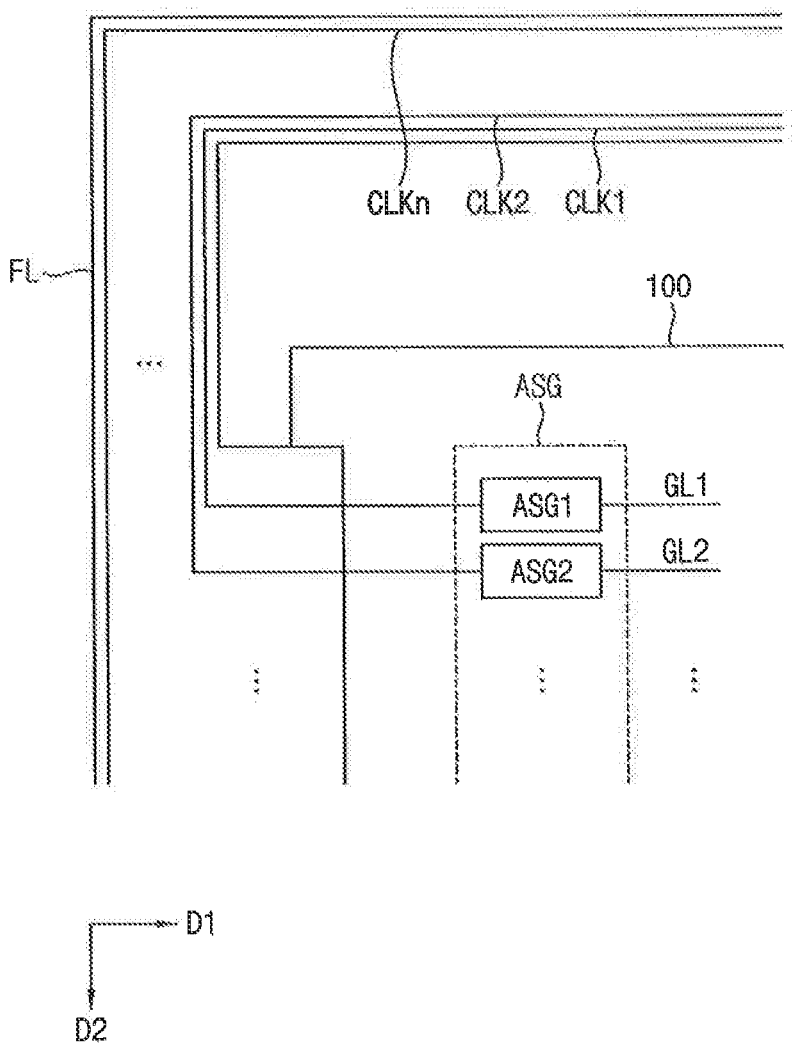
FIG. 7 is a partially enlarged view illustrating an upper left portion of the display apparatus of FIG. 6.

FIG. 6 is a plan view illustrating a display apparatus according to an example embodiment of the inventive concept. FIG. 7 is a partially enlarged view illustrating an upper left portion of the display apparatus of FIG. 6.

Referring now to FIG. 6, the display apparatus shown may be substantially same as the display apparatus shown in FIGS. 1 to 3, except for a flexible film FL, and a clock line CLK. Therefore, the description of FIG. 6 will be simplified or omit with regard to the similar structures and/or functions previously discussed in the description of FIGS. 1 to 3.

The display apparatus of FIG. 6 may include a display panel 100, a driving board (driving substrate 200), a driving circuit part DR including a timing controller 210, a gate driver 220 and a gamma reference voltage generator 230, a gate signal generator ASG, a data driver 240, a voltage generator (not shown), a flexible film FL and a flexible circuit board 300.

The display panel 100 may include a display area DA for displaying an image and a peripheral areas PA which is a non-display area disposed adjacent to the display area DA.

The display panel 100 may include a plurality of gate lines G1 to Gn and a plurality of data lines D1 to Dm, and a plurality of unit pixels which are electrically connected to each of the gate lines G1 to Gn and the data lines D1 and Dm.

The flexible film FL may be formed as one continuous film, unlike the first to fourth flexible films of the display device of FIG. 1 and FIG. 4. In some example embodiments of the inventive concept, the flexible film FL may be formed by dividing the flexible film FL into a plurality of flexible films similar to the display apparatus of FIG. 1 and FIG. 4.

The flexible film FL may be connected to the driving substrate 200, and disposed adjacent to the gate signal generator ASG at a side of the display panel 100 in a first direction D1 to be connected to the display panel 100.

The clock line CLK may extend from the gate driver 220 on the driving substrate 200 to the gate signal generator ASG through the driving substrate 200, the flexible film FL, the peripheral region PA of the display panel 100, the flexible substrate FL to be connected to the gate signal generator ASG. A person of ordinary skill in the art should understand and appreciate that the arrangement of the flexible substrate and the gate signal generator are shown on the left side in FIG. 6, the embodiments of the inventive concept are not limited thereto. For example, the flexible film FL and the gate signal generator ASG may be arranged on the right side, e.g. the non-display peripheral area may be adjacent the display area DA along the right side of the display area DA. In addition, the arrangement of the gate driver 220 and the gamma reference voltage generator 230 (and the timing controller 210) on the driving circuit DR may be different than shown in FIG. 6.

Figure 8:
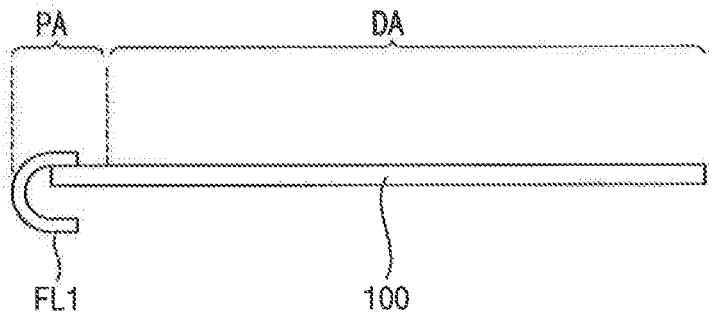
FIG. 8 is a side cross-sectional view illustrating a display apparatus according to an embodiment of the inventive concept.

FIG. 8 is a side cross-sectional view illustrating a display apparatus according to an embodiment of the inventive concept.

Referring to FIG. 8, the first flexible film FL1 of the display apparatus may be bent into, for example, a c-shape so that an edge of the display panel 100 on a cross-sectional view can be disposed between both ends of the first flexible film FL1. As this structure may have the clock lines disposed on the first flexible film FL1 having the c-shape, the peripheral area of the display panel can be decreased from the case where the clock lines are not disposed for example, on the display panel. Thus, a width of the peripheral area PA, which is a non-display area adjacent to the display area DA, may be reduced by having the first flexible film having a c-shape such as shown in FIG. 8.

Figure 9:
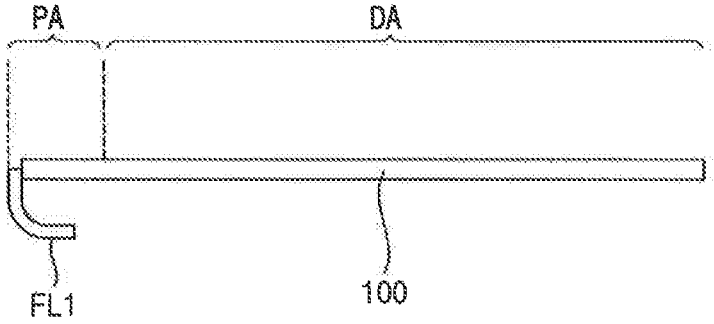
FIG. 9 is a side cross-sectional view illustrating a display apparatus according to an embodiment of the inventive concept.

FIG. 9 is a side cross-sectional view illustrating a display apparatus according to an embodiment of the inventive concept.

Referring to FIG. 9, a first flexible film FL1 of the display apparatus may be bonded to a side of a display panel 100 (side bonding), and may be bent toward a lower side (e.g. a back) of the display panel 100, to dispose the first flexible film FL1 on the side of the display panel 100 and on the back of the display panel 100. Accordingly, a width of a peripheral area PA, Which is a non-display area adjacent to a display area DA, can be reduced as some or most of the clock lines may be disposed on the first flexible film FL1 as shown in FIG. 9. The side bonding may be performed by any of various methods known to a person of ordinary skill in the art such as attaching a wiring of the first flexible film FL1 by using a conductive tape or the like, so that the wiring of the first flexible film FL1 is electrically connected to an exposed wiring at the side of the display panel.

Figure 10A:
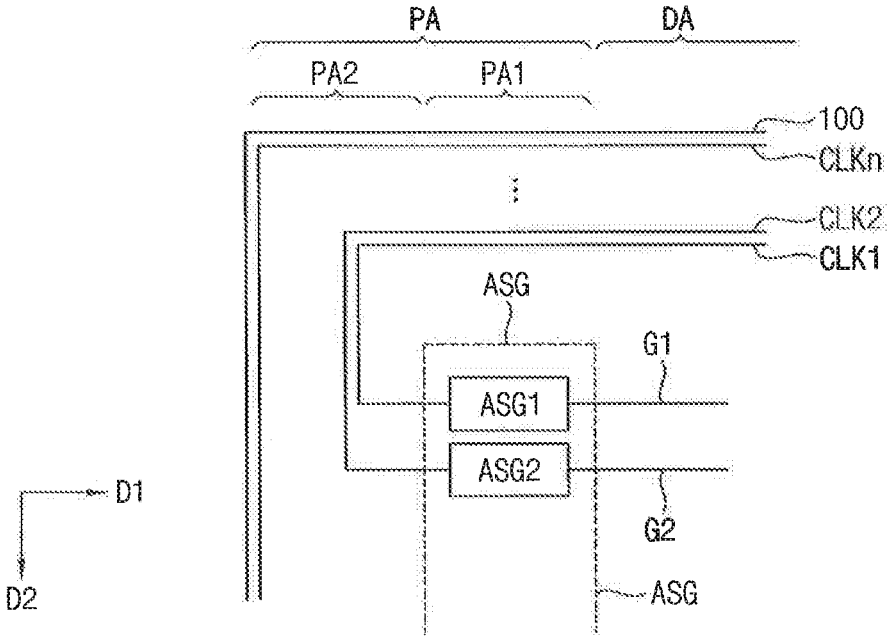
FIGS. 10A and 10B are views comparing a width of a peripheral area of a display apparatus according to the related art and a width of a peripheral area of a display apparatus according to an embodiment of the inventive concept.
Figure 10B:
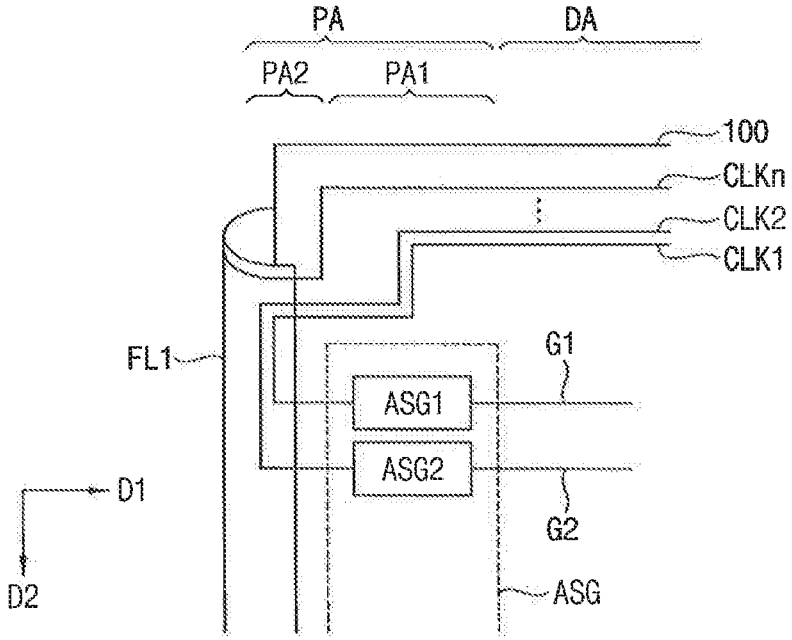

FIGS. 10A and 10B are views comparing a width of a respective peripheral area of a display apparatus according to the related art and a width of a peripheral area of a display apparatus according to an embodiment of the inventive concept.

Referring to FIG. 10A, the display apparatus utilizes a space PA2 for clock lines CLK1, CLK2, and CLKn to extend in the second direction D2. Accordingly, a peripheral area PA, which is a non-display area, includes the space PA1 for the gate signal generation portion ASG and the space PA2 for the clock lines. Therefore, the width of the peripheral area PA in the first direction D1 may be increased by the arrangement of clock lines and the signal generation portion ASG in respective peripheral areas PA1 and PA2.

However, referring to FIG. 10B, in a display apparatus according to an embodiment of the inventive concept, portions of clock lines CLK1, CLK2, and CLKn, which extend in the second direction D2, are formed on a first flexible film FL1, and the first flexible film FL1 may be arranged in a space PA2 to be connected to the display panel 100 and space PA1 for the gate signal generator ASG, so that a width of the peripheral portion PA in the first direction D1 may decrease.

Figure 11:
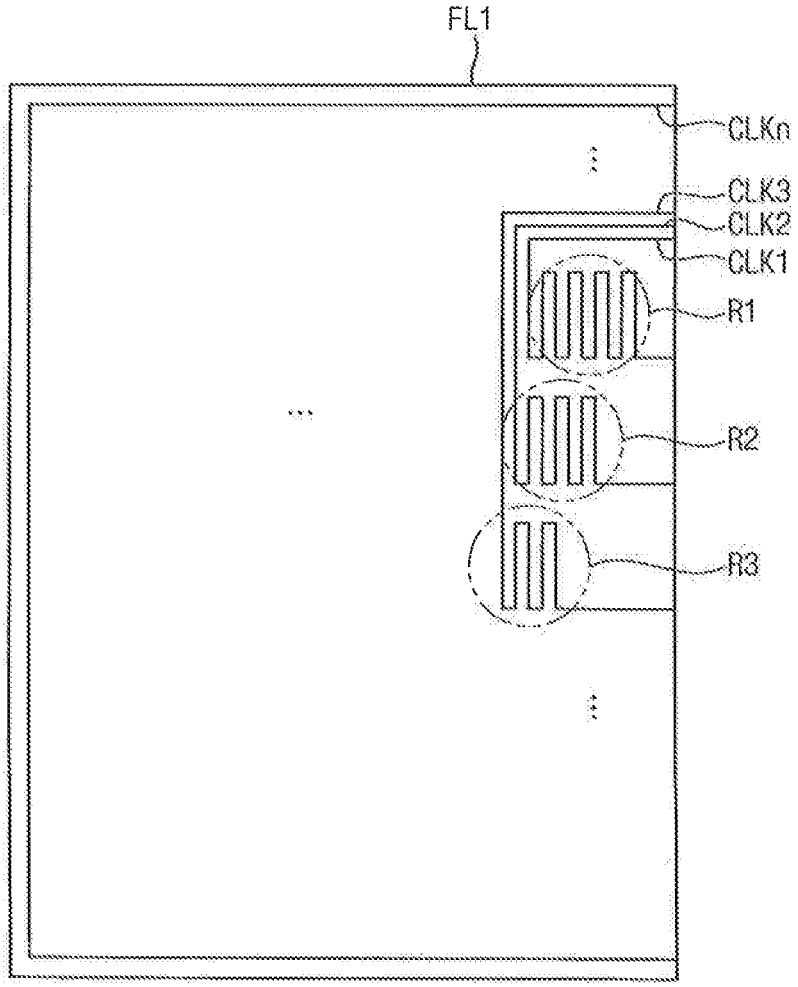
FIG. 11 is a plan view illustrating a first flexible film of a display apparatus according to an embodiment of the inventive concept.

FIG. 11 is a plan view illustrating a first flexible film of a display apparatus according to an embodiment of the inventive concept.

Referring now to FIG. 11, the first flexible film FL1 shown may be substantially the same as the first flexible film FL1 of the display apparatus of FIGS. 1 to 3, except for resistance portions R1, R2 and R3. Therefore, repeated description will be omitted.

The first flexible film FL1 may include a first clock line CLK1, a second clock line CLK2, a third clock line CLK3, a n-th clock line CLKn. The first clock line CLK1 may include a first resistor R1, the second clock line CLK2 may include a second resistor R2, and the third clock line CLK3 may includes a third resistor R3. Each of the first to third resistors R1, R2, and R3 may have resistance values that are inversely proportional to a length of the first to third clock lines on the first flexible film FL1. Accordingly, the resistance values of each of the clock lines may be equal to each other.

According to the first flexible film FL1, the resistance portions are formed corresponding to the clock lines, so that the resistance values of the clock lines become equal to each other. Thus, a deviation of the clock signal according to the difference in the length of the clock lines can be reduced and the display quality is increased.

According to example embodiments of the inventive concept, a display apparatus may include a display panel, a gate driver, a gate signal generator, a clock line, and a flexible film. Most of the clock lines may be formed on the flexible film, and circuit wirings formed on the flexible film generally have a small resistance value compared with circuit wirings integrated on the display panel, so that a load may be reduced. Thus, even if the display apparatus is enlarged, deterioration of display quality due to delay of the clock signal can be prevented.

In addition, as most of the clock lines are formed on the flexible film, and size of a peripheral area, which is the non-display region, can be reduced compared to a case where the entire clock line is formed on the peripheral area of the display panel 100. Accordingly, a display apparatus with a reduced bezel width can be provided.

In addition, the flexible film may include a plurality of flexible films, and these flexible films can be formed of the same film, and can be applied to a single film design, so that the manufacturing costs can be reduced.

In addition, the flexible film may be bent toward a lower side of the display panel, or side-bonded at a side of the display panel, so that bezel width can be further reduced as the clock lines may be arranged along the flexible film, which may include the curved portion of the flexible film, which provides for a reduced peripheral area when, for example, the clock lines are arranged on a peripheral area of the display panel.

In addition, the clock lines of the flexible film may include a resistance portion, so that deviation of clock signal according to a difference in a length of the clock line can be reduced and the display quality can be increased.

The foregoing is illustrative of the inventive concept and is not to be construed as limiting thereof. Although a few example embodiments of the inventive concept have been described, those skilled in the art will readily appreciate that many modifications are possible in the example embodiments without materially departing from the novel teachings of the embodiments of the inventive concept. Accordingly, all such modifications are intended to be included within the scope of the inventive concept as defined in the claims. Therefore, it is to be understood that the foregoing is illustrative of the embodiments of the inventive concept and is not to be construed as limited to the specific example embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display apparatus, comprising:

a display panel comprising a display area in which an image is displayed and a peripheral area comprising a non-display area being disposed adjacent to the display area, the display panel comprising a plurality of gate lines extending in a first direction, a plurality of data lines extending a second direction which crosses the first direction, and a plurality of unit pixels electrically connected to each of the plurality of gate lines and the plurality of data lines;

a gate driver configured to generate a clock signal;

a gate signal generator disposed in the peripheral area, in which the gate signal generator receives the clock signal from the gate driver, generates a gate signal, and outputs the gate signal to at least one of the plurality of gate lines;

at least one clock line that transmits the clock signal generated from the gate driver to the gate signal generator;

a flexible circuit board comprising a data driver and extending from the display panel; and a flexible film disposed adjacent to the gate signal generator in the first direction and extending from the display panel, the flexible film being connected to the display panel in the peripheral area, the flexible film being spaced apart from the gate signal generator, wherein at least a portion of the at least one clock line is formed on the flexible film, and wherein the at least one clock line passes through both the peripheral area of the display panel and the flexible film to make connection between the gate driver and the gate signal generator.

2. The display apparatus of claim 1, wherein a thin-film transistor of the gate signal generator and a thin-film transistor of a unit pixel of the plurality of unit pixels are formed from a same layer.

3. The display apparatus of claim 2, further comprising:

a driving substrate on which the gate driver is mounted, wherein the flexible film is directly connected to the driving substrate, and wherein the at least one clock line extends from the gate driver of the driving substrate to the gate signal generator through the driving substrate, the flexible film, and the peripheral area of the display panel to be connected to the gate signal generator.

4. The display apparatus of claim 3, wherein the at least one clock line comprises a plurality of clock lines that extend from the gate driver of the driving substrate to the gate signal generator through the driving substrate, the flexible circuit board, the peripheral area of the display panel, the flexible film and onto the peripheral area of the display panel for connection to the gate signal generator.

5. The display apparatus of claim 3, wherein:

the data driver is configured to generate a data voltage output to the plurality of data lines, and wherein the plurality of data lines extend from the data driver into the display area through the flexible circuit board, and the peripheral area of the display panel.

6. The display apparatus of claim 1, wherein the at least one clock line comprises a plurality of clock lines formed on a portion of the flexible film extending from the display panel.

7. The display apparatus of claim 6, wherein the plurality of clock lines formed on the flexible film have a resistance value less than a resistance of clock lines integrated on the display panel.

8. The display apparatus of claim 1, wherein the gate signal generator comprises a left gate signal generator formed on a left side of the display panel and a right gate signal generator formed on a right side of the display panel, and at least one of the plurality of gate lines is connected to the left gate signal generator and the right gate signal generator, and wherein the flexible film comprises:

a first flexible film disposed adjacent to the left gate signal generator; and a second flexible film disposed adjacent to the right gate signal generator, wherein the at least one clock line comprises a left clock signal line electrically connected to the left gate signal generator and a right clock signal line electrically connected to the right gate signal generator.

9. The display apparatus of claim 1, wherein the flexible film comprises at least a first flexible film and a second flexible film spaced apart from the first flexible film in the second direction, the at least one clock line comprises a first clock line, an a-th clock line, and an a+1-th clock line in which 'a' is a natural number greater than 1;

the gate signal generator comprises a first gate signal generator, an a-th gate signal generator, and an a+1-th gate signal generator, the first clock line and the a-th clock line extend from the gate driver to the first gate signal generator and the a-th gate signal generator through the peripheral area of the display panel, the first flexible film, the peripheral area of the display panel, and the a+1-th clock line extends from the gate driver to the a+1-th gate signal generator through the peripheral area of the display panel, the first flexible film, the peripheral area of the display panel, the second flexible film, and the peripheral area of the display panel.

10. The display apparatus of claim 9, wherein the first flexible film and the second flexible film are comprised of substantially a same material.

11. The display apparatus of claim 10, wherein the first flexible film and the second flexible film each comprise first to n-th lines, and at least one of the first to n-th lines of the second flexible film is floated as a dummy pattern.

12. The display apparatus of claim 1, further comprising:

a timing controller which receives an input image data and an input control signal, and generates a first control signal, a second control signal, a third control signal and a data signal; and a gamma reference voltage generator which receives the third control signal and generates a gamma reference voltage; wherein the data driver which receives the second control signal, the data signal, and the gamma reference voltage, and outputs a data voltage to the plurality of data lines, and wherein the gate driver receives the first control signal.

13. The display apparatus of claim 12, further comprising:

a driving substrate on which the timing controller, the gamma reference voltage generator and the gate driver are mounted, wherein the flexible circuit board connects the driving substrate to the display panel, and wherein the at least one clock line extends from the gate driver of the driving substrate to the gate signal generator through the driving substrate, the flexible circuit board, the peripheral area of the display panel, the flexible film and the peripheral area of the display panel and is connected to the gate signal generator.

14. The display apparatus of claim 1, wherein the flexible film is bent in C-shape, wherein an edge of the display panel on a cross-sectional view is disposed between both ends of the flexible film, and the at least one clock line comprises a plurality of clock lines arranged on the flexible film.

15. The display apparatus of claim 1, wherein the flexible film is bonded to a side of the display panel.

16. The display apparatus of claim 1, wherein the at least one clock line on the flexible film comprises at least a first clock line and a second clock line, and the first clock line comprises a first resistance portion, and the second clock line comprises a second resistance portion having a resistance value different from that of the first resistance portion.

17. A display apparatus, comprising:

a gate driver configured to generate first and second clock signals;

a first gate signal generator which is directly integrated on a display panel, and configured to receive the first clock signal and generate a first gate signal;

a second gate signal generator which is directly integrated on the display panel, and configured to receive the second clock signal and generate a second gate signal;

at least one gate line electrically connected between the first gate signal generator and the second gate signal generator, configured to receive the first and second gate signals, and extending in a first direction;

at least one first clock line electrically connected between the gate driver and the first gate signal generator to transmit the first clock signal;

at least one second clock line electrically connected between the gate driver and the second gate signal generator to transmit the second clock signal;

a flexible circuit board comprising a data driver and extending from the display panel;

a first flexible film disposed adjacent to the first gate signal generator in the first direction and extending from a peripheral area of a first side of the display panel, the first flexible film connected to the display panel, and a portion of the at least one first clock line is formed on the first flexible film, the first flexible film being spaced apart from the first gate signal generator; and a second flexible film disposed adjacent to the second gate signal generator in the first direction and extending from a peripheral area of a second side of the display panel, the second flexible film connected to the display panel, and a portion of the at least one second clock line is formed on the second flexible film, the second flexible film being spaced apart from the second gate signal generator, wherein the at least one first clock line passes through both the peripheral area of the first side of the display panel and the first flexible film to make connection between the gate driver and the first gate signal generator, and wherein the at least one second clock line passes through both the peripheral area of the second side of the display panel and the second flexible film to make connection between the gate driver and the second gate signal generator.

18. The display apparatus of claim 17, wherein the first and second flexible films extends along first and second edges of the display panel in a second direction perpendicular to the first direction.

19. The display apparatus of claim 17, wherein each of the first gate signal generator and the second gate signal generator comprises a thin-film transistor.

* * * * *